US006296526B1

(12) United States Patent
Hussaini et al.

(10) Patent No.: US 6,296,526 B1
(45) Date of Patent: Oct. 2, 2001

(54) CIGARETTE LIGHTER ADAPTER WITH GRIPPING STRUCTURE

(75) Inventors: Saied Hussaini; Marc Iacovelli, both of Miami, FL (US)

(73) Assignee: Rally Mfg., Inc., Miami, FL (US)

( * ) Notice: Subject to any disclaimer, the term of this patent is extended or adjusted under 35 U.S.C. 154(b) by 0 days.

(21) Appl. No.: 09/520,369

(22) Filed: Mar. 7, 2000

(51) Int. Cl.[7] ..... H01R 24/04
(52) U.S. Cl. ..... 439/668
(58) Field of Search ..... 439/138, 668, 439/484; D13/144

(56) References Cited

U.S. PATENT DOCUMENTS 1,685,608 * 9/1928 Lipschutz ..... 439/483
2,605,318 * 7/1952 Morgenstern ..... 439/668
5,170,067 * 12/1992 Baum et al. ..... 307/10.1

* cited by examiner

*Primary Examiner*—Tulsidas Patel
*Assistant Examiner*—Michael C. Zarroli
(74) *Attorney, Agent, or Firm*—Liniak, Berenato, Longacre & White

(57) ABSTRACT

A cigarette lighter adapter for an electronic device has an exterior gripping portion featuring a textured surface for gripping by the user and a finger hole for a user's finger to be inserted through to facilitate the insertion and removal of the adapter from a cigarette lighter socket. The exterior gripping portion and the finger hole permit the user to have a secure hold on the adapter without putting any tension on the adapter cord, thereby eliminating the possibility of damage to the cord and to the internal components of the adapter.

5 Claims, 2 Drawing Sheets

CIGARETTE LIGHTER ADAPTER WITH GRIPPING STRUCTURE

BACKGROUND OF THE INVENTION

1. Field of the Invention

The present invention relates generally to cigarette lighter adapters for a cellular telephone or the like, and more particularly to adapters that adapt electrical components for use in a vehicle.

2. Description of Related Art

Cellular telephones are extremely popular and are being used by a larger segment of the population hand-held cellular telephones may be used by their owners either in or outside of vehicles. When the telephone is one that is normally carried by the user, an adapter is required to run the telephone off of the vehicle electrical power rather than the telephone battery. The present invention is directed to a cigarette lighter adapter for an electronic device, such as a cellular telephone, featuring finger gripping portions and cord protection means.

The prior art describes a number of adapters that permit operation of various electronic devices from the electrical power source of a vehicle, particularly from the cigarette lighter within a vehicle. These adapters all share certain common components. The present invention is not focused on such common components as it is directed to a cord protection means which has been absent from the prior art, which facilitates a user to remove the adapter from the vehicle cigarette lighter without damage to the adapter cord. Particularly the invention provides a gripping means which protects the cord of the adapter from damage. In prior art without such means, a user could be tempted to remove the adapter from the socket of the cigarette lighter by pulling on the cord, and thereby tension exerted on the cord could be damaging to the internal components of the adapter.

It is an object of the invention to provide an improved gripping means for a cigarette lighter adapter.

A specific feature of the invention to provide a cord protection means for a cigarette lighter adapter.

It is a further object of the invention to provide a cigarette light adapter for a cellular telephone with a separate grip portion that provides a textured surface for a user to grip.

A specific object of the invention is to provide a separate finger gripping portion which a user can grip with a finger and further provide the advantage of protecting the adapter cord from being pulled or damaged.

It is another object of the invention to provide an insulated grip portion adapter.

SUMMARY OF THE INVENTION

The invention is a cigarette lighter adapter having an elongated housing. The housing has a main body portion and a barrel portion, the barrel portion sized to fit snugly within a cigarette lighter socket. The housing has an internal cavity extending through the main body portion and the barrel portion for housing electronic components of the cigarette lighter adapter. A conductive tip contact is disposed on a front end of the barrel portion. Grounding contact members are disposed on opposing sides of the barrel portion. The tip contact and the grounding contact members are operative with the electronic components of the cigarette lighter adapter.

A cord passage is formed in a rear wall of the main body portion through which an electrical cord extends to connect with the electronic components of the cigarette lighter adapter. A contoured finger gripping hole passes through the main body portion, the finger gripping hole being positioned forward of the cord passage.

The cigarette lighter adapter further includes an exterior gripping area disposed on a top portion of the main body portion of the housing. The improved cigarette lighter adapter exterior gripping portion features a textured surface for gripping by the user and a finger hole for a user's finger to be inserted through to facilitate the insertion and removal of the adapter from a cigarette lighter socket. The textured portion has raised knob-like members for improved gripping contact. The textured portion may be formed integrally with the housing or may be a portion attached to the main body housing. The textured portion may be a rubber-like material for enhanced gripping.

BRIEF DESCRIPTION OF THE DRAWINGS

The above mentioned advantages and objects of the present invention will further become apparent when taken with the detailed description of the invention and with the drawings in which.

DETAILED DESCRIPTION OF THE INVENTION

Figure 1:
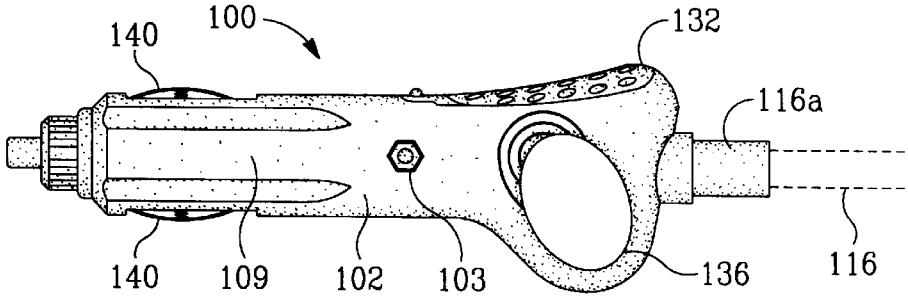
FIG. 1 depicts a side elevation view of a cigarette lighter adapter according to the present invention.
Figure 2:
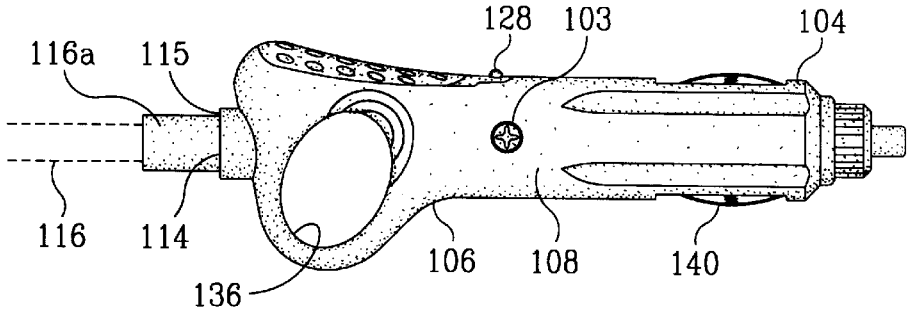
FIG. 2 shows an opposite side elevation view of the cigarette lighter adapter of FIG. 1.
Figure 3:
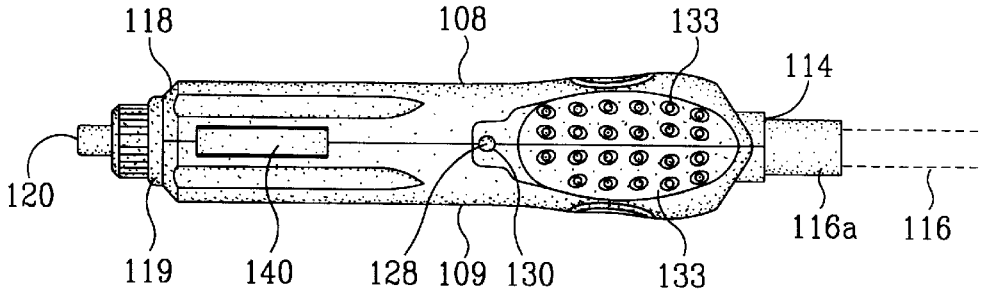
FIG. 3 shows the cigarette lighter adapter of FIG. 1 from above, according to the present invention.
Figure 4:
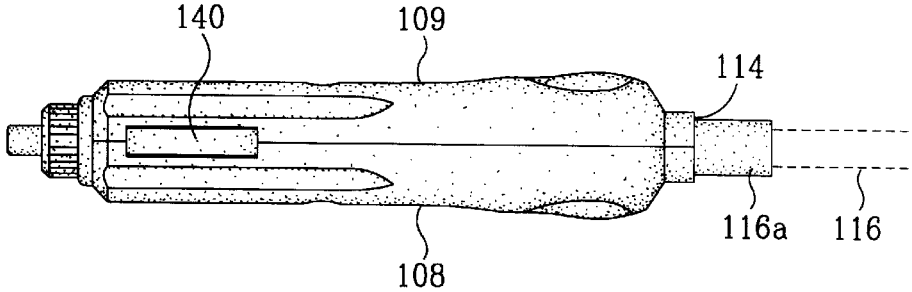
FIG. 4 is a bottom view of the cigarette lighter adapter of FIG. 1 according to the invention.
Figure 5:
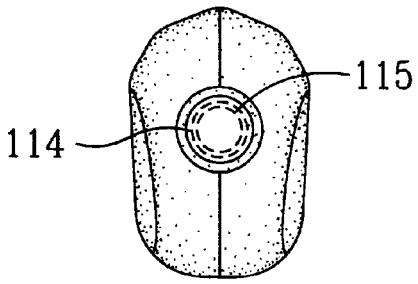
FIG. 5 shows a rear end view of the cigarette lighter adapter according to the present invention.
Figure 6:
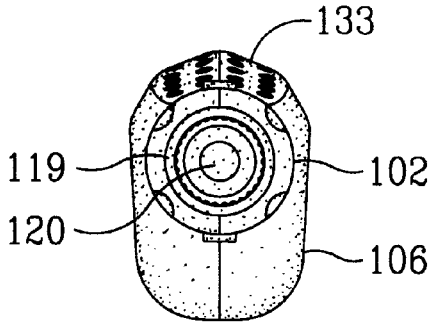
FIG. 6 shows the opposite forward end view of the cigarette lighter adapter according to the present invention.
Figure 7:
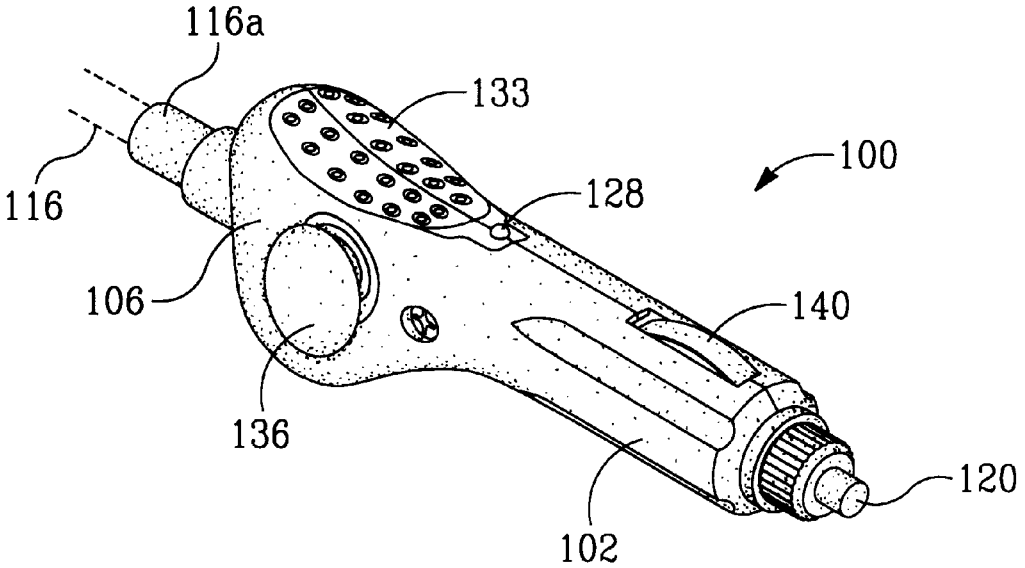
FIG. 7 shows a perspective illustration of the cigarette lighter adapter according to the present invention.

Referring now to FIGS. 1 through 7, a cigarette lighter adapter 100 is shown constructed in accordance with the principles of the present invention. The adapter 100 is insertable into a cigarette lighter socket (not shown) of a vehicle to draw power from the vehicle in order to power an electronic device, such as cellular telephone, spot light, air compressor, etc. The adapter 100 has a plastic housing 102 that encloses the relevant components thereof and may be considered as having two interconnected sections secured together by fastening means 103. One section includes an elongated, cylindrical barrel portion 104 having a diameter that is dimensioned to be received within the vehicle lighter socket (not shown). The second section is a main body portion 106 that is attached to, but is generally larger than the barrel portion 104. The main body portion 106 and the barrel portion 104 are hollow so that they cooperatively form an internal cavity of the adapter 100 that houses and encloses the electronic components of the adapter 100. The barrel and main body portions 104 & 106 of the adapter 100 may be easily formed from a plastic by a suitable process such as injection molding.

The adapter housing 102 may be formed by molding two opposing halves 108, 109 that engage with each other. As an alternative to the fastening means 103, one such opposing half may include recessed female receptacles (not shown)

formed in boss sections of the housing. These receptacles receive male pins (not shown) that project from the other housing half 108 and the engagement between the two housing halves 108, 109 is in the manner of a press-fit engagement as would be understood by those skilled in the art. An interior lip (not shown) may be provided along the interior edges of the housing half 109 and this lip may be received in a corresponding recess of the other housing half 108.

Each housing half 108, 109 includes a passage 114 formed in the rear wall 115 thereof through which an electrical cord 116 extends for connection to the electronic device (not shown).

Preferably, a strain relief member 116*a* is provided at the interface of the electrical cord 116 and the passage 114. At the forward end 118, each housing half 108, 109 includes a similar cylindrical passage 119 formed therein which accommodates a cylindrical conductive tip contact 120. This tip contact engages, as is known in the art, a "hot" contact of the vehicle electrical system that is typically disposed at the center and end portion of the cigarette lighter socket (not shown). This tip contact 120 is electrically connected in a conventional manner to one or more "hot" or "live" circuits disposed on an internal circuit board. This connection is typically made by a conductive spring not shown) that biases the tip contact 120 forwardly within the housing end passage 119. The spring is connected to the circuit board in a suitable manner such as soldering. The circuits disposed on the circuit board may include a transformer circuit that either steps the voltage of the vehicle electrical system up or down to a level appropriate to run a specific electronic device, a charging circuit for charging the electronic device during operation, or even merely a circuit that provides a simple electrical connection between the vehicle and the electronic device. As such, the circuits may include electrical components such as capacitors and resistors as well as integrated circuits in the form of chips. The aforementioned electrical connections and components internal to the cigarette lighter adapter will be understood by those skilled in the art and further discussion thereof as such is unnecessary.

As part of the internal circuitry (not shown) of the adapter 100, an indicator, such as a light-emitting diode ("LED") 128 may be provided and positioned within an opening 130 of the housing 102. This LED 128 indicates to the user that the adapter 100 is operational and a connection has been established with the vehicle electrical system through the lighter socket 102.

To facilitate the gripping thereof by a user when either inserting or removing the adapter 100 from the cigarette lighter socket 101, a top portion 132 of the main body 106 may include textured portions 133 on opposite extents of the top portion 132. These portions 133 may include a plurality of raised knob-like members 134 or any other similar pattern. These textured portion are preferably integral with the housing halves 108, 109, and may be formed as an integral part of the housing during the aforementioned injection molding.

As described previously, the adapter includes an exterior grip portion 132, 133. This grip portion may be alternatively formed from a resilient material, such as an elastomer or soft plastic to provide an enhanced gripping surface. The textured pattern may be attached thereon after the construction of the housing halves 108, 109 by suitable means. The soft plastic grip portion also provides a measure of heat insulation to the adapter. It will be understood that the elastomer covering is not limited to only the top portion of the gripping area.

The top portion 132 may be formed from a flexible or resilient material, such as rubber, an elastomer or a soft plastic, which covers the top portion 132 of the gripping area of the cigarette lighter adapter. The circuitry of the adapter 100 inevitably produces heat during operation and in this regard, thus the rubber covered area 132 provides an insulating layer for the adapter 100. The textured portions 133 provide an exterior surface that may be reliably gripped by the user regardless of the surrounding temperature.

In an important aspect of the invention, the adapter 100 includes a contoured finger gripping hole 136 through which a user can insert a finger to securely get hold of the rear portion of the adapter 100. When a user inserts a forefinger through the finger gripping hole 136, the user's thumb becomes positioned on the top portion 132 on the textured area 133 of the adapter 100. The textured portion 133 acts mainly as a thumb grip. When gripped using the finger hole 136 and the textured area 133, the adapter may be gripped firmly and easily pulled from the cigarette lighter socket without any tension to the cord 116. These features of the invention protect the adapter cord 116 from damage and prolong the life of the cigarette lighter adapter.

The adapter 100 includes a pair of contact members 140 that provide a ground path or contact between a ground of the adapter circuitry and a ground of the vehicle electrical system. The vehicle system ground typically includes the interior walls 141 of the cigarette lighter socket 101.

Having thus described various exemplary embodiments of the invention, it will be understood by those skilled in the art that modifications or changes in details of the invention may be implemented without departing from the spirit and scope of the invention as defined in the following claims.

What is claimed is:

1. A cigarette lighter adapter comprising:

an elongated housing defining an elongated axis, the housing having a main body portion and a barrel portion, said barrel portion sized to fit snugly within a cigarette lighter socket, the housing having an internal cavity extending through said main body portion and said barrel portion for housing electronic components of the cigarette lighter adapter;

a conductive tip contact disposed on a front end of said barrel portion and grounding contact members disposed on opposing sides of said barrel portion, said tip contact and said grounding contact members operative with the electronic components of said cigarette lighter adapter;

a cord passage formed in a rear wall of said main body portion through which an electrical cord extends to connect with the electronic components of the cigarette lighter adapter;

a finger receiving surface disposed on an external surface of said main portion and a finger gripping hole passing through said main body portion, said finger gripping hole positioned forward of said cord passage and offset from said longitudinal axis, wherein said finger receiving surface is disposed opposite said finger gripping hole with respect to said longitudinal axis, said finger gripping hole and said finger receiving surface defining a substantially pistol-grip arrangement whereby the finger gripping hole is disposed to receive a user's index finger and said finger receiving surface is disposed to receive said user's thumb.

2. The cigarette lighter adapter according to claim 1, wherein said finger receiving surface includes a textured portion.

3. The cigarette lighter adapter according to claim 2, wherein said textured portion comprises raised knob-like members.

4. A cigarette lighter adapter comprising, an elongated housing, the housing having a main body portion and a barrel portion, said barrel portion sized to fit snugly within a cigarette lighter socket, the housing having an internal cavity extending through said main body portion and said barrel portion for housing electronic components of the cigarette lighter adapter;

a conductive tip contact disposed on a front end of said barrel portion and grounding contact members disposed on opposing sides of said barrel portion, said tip contact and said grounding contact members operative with the electronic components of said cigarette lighter adapter;

a cord passage formed in a rear wall of said main body portion through which an electrical cord extends to connect with the electronic components of the cigarette lighter adapter; and a finger gripping hole passing through said main body portion, said finger gripping hole positioned forward of said cord passage a gripping area disposed on a top portion of said main body portion of said housing: said gripping area including a textured portion having raised knob-like members, wherein said textured portion is attached to said main body housing and said textured portion comprises a rubber-like material for enhanced gripping.

5. A cigarette lighter adapter, comprising:

an elongated housing defining an elongated axis, the housing having a main body portion and a barrel portion, said barrel portion sized to fit snugly within a cigarette lighter socket, the housing having an internal cavity extending through said main body portion and said barrel portion;

electronic components contained within said internal cavity of said housing;

a conductive tip contact disposed on a front end of said barrel portion;

grounding contact members disposed on opposing sides of said barrel portion, said tip contact and said grounding contact members connected to and operative with said electronic components of said cigarette lighter adapter;

a cord passage formed in a rear wall of said main body portion;

an electrical cord extending through said cord passage and connected with said electronic components of the cigarette lighter adapter; and a finger receiving surface disposed on an external surface of said main portion and a finger gripping hole passing through said main body portion, said finger gripping hole positioned forward of said cord passage and offset from said longitudinal axis, wherein said finger receiving surface is disposed opposite said finger gripping hole with respect to said longitudinal axis, said finger gripping hole and said finger receiving surface defining a substantially pistol-grip arrangement whereby the finger gripping hole is disposed to receive a user's index finger and said finger receiving surface is disposed to receive said user's thumb.

* * * * *